US008592022B2

(12) United States Patent
Cardinell

(10) Patent No.: US 8,592,022 B2
(45) Date of Patent: Nov. 26, 2013

(54) WASHER AND DRYER GAP BRIDGING DEVICE

(76) Inventor: Jennifer Lynn Cardinell, Lilburn, GA (US)

( * ) Notice: Subject to any disclaimer, the term of this patent is extended or adjusted under 35 U.S.C. 154(b) by 639 days.

(21) Appl. No.: 12/717,874

(22) Filed: Mar. 4, 2010

(65) Prior Publication Data

US 2010/0227113 A1 Sep. 9, 2010

Related U.S. Application Data

(60) Provisional application No. 61/157,961, filed on Mar. 6, 2009.

(51) Int. Cl.

| | |
|---|---|
| ***B32B 3/06*** | (2006.01) |
| ***B32B 3/10*** | (2006.01) |
| ***B23P 11/00*** | (2006.01) |

(52) U.S. Cl.
USPC ..... 428/99; 428/98; 428/100; 428/223

(58) Field of Classification Search
USPC ..... 428/99, 98, 100, 223
See application file for complete search history.

(56) References Cited

U.S. PATENT DOCUMENTS 5,056,663 A * 10/1991 Ostrowski ..... 206/424
7,299,573 B1 * 11/2007 Kuncken ..... 38/140

* cited by examiner

*Primary Examiner* — Brent O'Hern

(57) ABSTRACT

A device for bridging a gap may be provided. The device may comprise a piece of material having a rectangular shape and that is of a size to cover at least a portion of a gap between a washer and a dryer, and a pair of magnets attached to the piece of material near opposite ends of the piece of material.

5 Claims, 3 Drawing Sheets

WASHER AND DRYER GAP BRIDGING DEVICE

CLAIM OF PRIORITY

The present application claims the benefit of U.S. Provisional Patent Application No. 61/157,961, filed on Mar. 6, 2009, which is incorporated herein by reference in its entirety.

BACKGROUND OF INVENTION

The present invention generally relates to appliances and, more specifically, relates to a device that bridges the gap between a washing machine and a clothes dryer.

When clothing or other small items are put on top of the washer or dryer, small items easily slip into a gap between the washer and dryer. In addition, side-by-side washers and dryers are often purposely installed with a gap between them in order to avoid contact from vibrations during the washing and drying process, thus further exacerbating the problem of items slipping into the gap between the washer and dryer.

As can be seen, what is needed are ways to prevent items from dropping into the gap between the washer and dryer.

SUMMARY OF THE INVENTION

In one aspect of the present invention, a device for bridging a gap comprises a piece of material having a rectangular shape and that is of a size to cover at least a portion of a gap between a washer and dryer; and a pair of magnets attached to the piece of material near opposite ends of the piece of material.

In another aspect of the present invention, a device for bridging a gap comprises a piece of material that is of a size to cover at least a portion of a gap between a washer and a dryer; and a plurality of fastening systems attached to the material near opposite long sides of the piece of material.

In a further aspect of the present invention, a method for covering a gap between a washer and a dryer comprises providing a gap bridging device, the device comprising: a rectangular piece of material that is of a size to cover at least a portion of a gap between a washer and a dryer; and a pair of magnets attached to the rectangular piece of material.

These and other features, aspects and advantages of the present invention will become better understood with reference to the following drawings, description and claims.

DETAILED DESCRIPTION OF THE INVENTION

Figure 1:
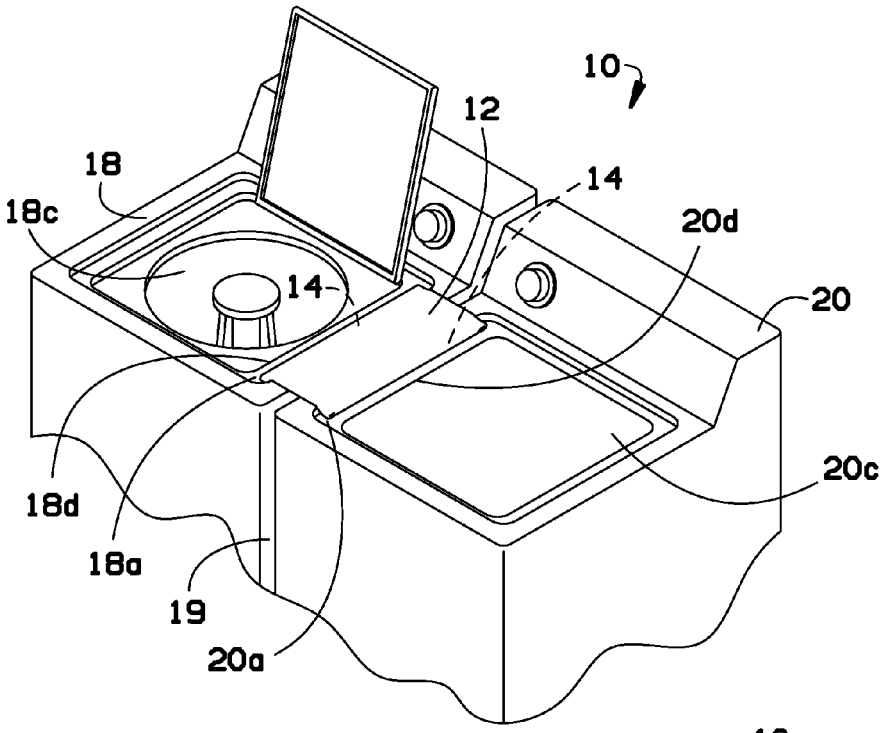
FIG. 1 shows a perspective view of a gap bridging device in accordance with an embodiment of the present invention.
Figure 2:
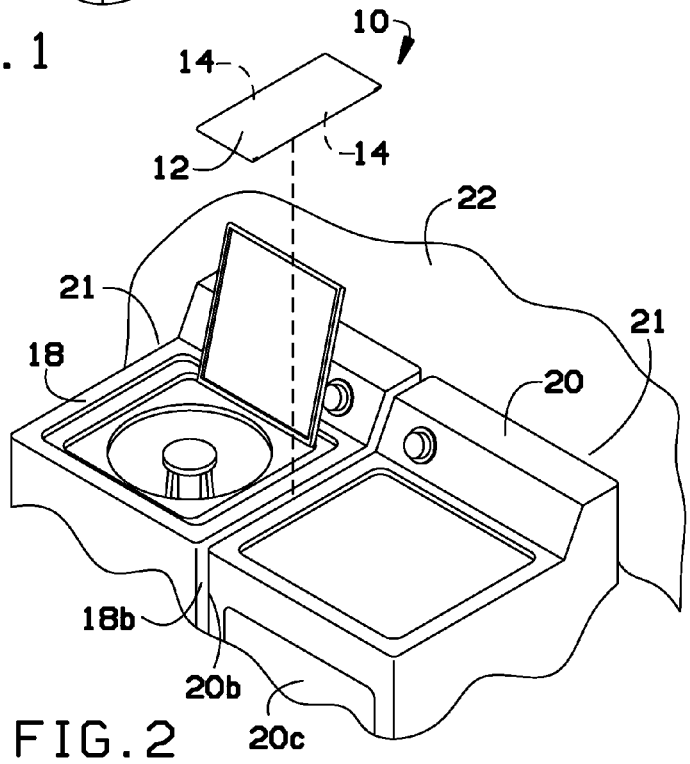
FIG. 2 shows another perspective view of the gap bridging device of FIG. 1.
Figure 3:
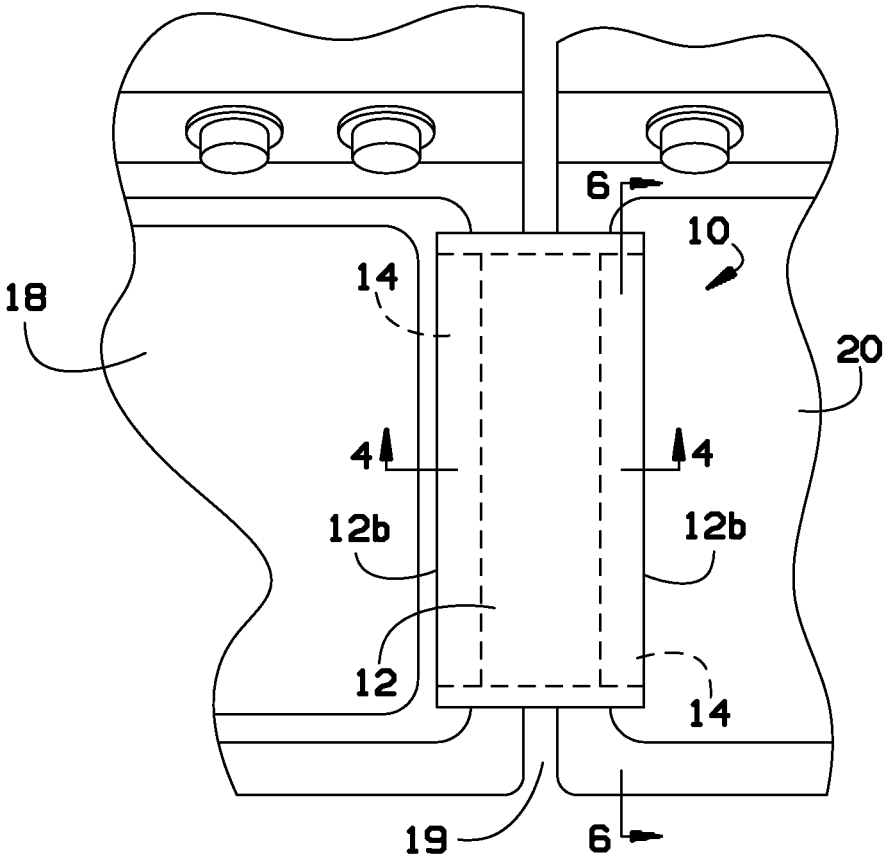
FIG. 3 shows a top view of the gap bridging device of FIG. 1.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

Broadly, embodiments of the present invention generally provide a gap bridging device that may be used to bridge and cover at least a portion of the gap between side-by-side washers and dryers in order to keep clothing or other items from falling through the gap between a washer and a dryer.

Referring now to FIGS. 1-4 and FIG. 6, a gap bridging device 10 may comprise a piece of material 12 and magnets 14. The piece of material 12 may typically be but may not necessarily be limited to a rectangular piece of lightweight and breathable fabric, such as a mesh material, that may be able to dry quickly and that may be sufficiently light so that the piece of material 12 may be supportable by the magnets 14. The piece of material 12 may also typically be white in color to avoid any transfer of color from wet items placed on it.

The magnets 14 may comprise one or more magnetic strips or any other suitable magnetic material. The magnets 14 may be secured to the piece of material 12 by being placed into a pair of sewn or sealed channels 12*a* on the two long sides 12*b* of the piece of material 12. The magnets 14 secured to the piece of material 12 may then be operable to hold the device 10 securely to a washer 18 and a dryer 20 in order to bridge at least a portion of a gap 19 between the washer 18 and the dryer 20, thereby providing a flat surface to fold, pile, or place items without the fear of losing items into the gap 19 between the washer 18 and the dryer 20. Alternatively, a plurality of magnets 14 may be placed along each of the two long sides 12*b*.

In an exemplary embodiment, the size of the device 10 may typically fall between fourteen to eighteen inches long and six inches to eight inches wide, although the device 10 may not necessarily be limited to these dimensions. The rectangular shape of the device 10 may allow it to adequately cover the length of the gap 19 and to cover a range of widths of the gap 19 while still being able to be held securely to the washer 18 and dryer 20.

In use, the device 10 may be disposed so that the piece of material 12 may be taut across the gap 19 between the washer 18 and dryer 20. The magnets 14 may lay flat against the top 18*a* and 20*a* of the washer 18 and dryer 20, respectively. The magnets 14 may be situated on the top 18*a* and 20*a* of the washer 18 and the dryer 20, respectively, so that the magnets 14 do not interfere with the lid areas 18*c* and 20*c* of the washer 18 and dryer 20, respectively, such as by making sure that the magnets 14 do not extend beyond the edge 18*d* of the washer 18 and edge 20*d* of a top-loading dryer 20.

Figure 4:
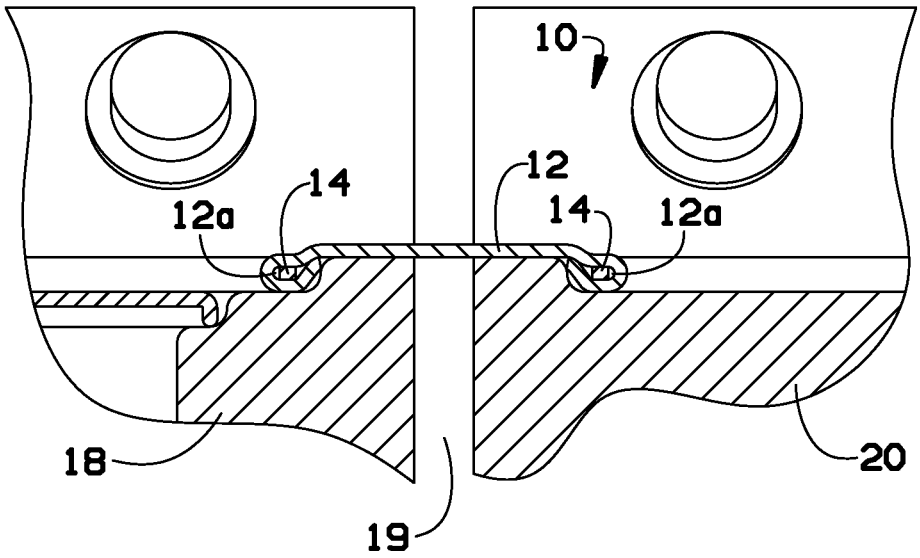
FIG. 4 shows a section view of the gap bridging device of FIG. 1 taken along line 4-4 of FIG. 3.
Figure 5:
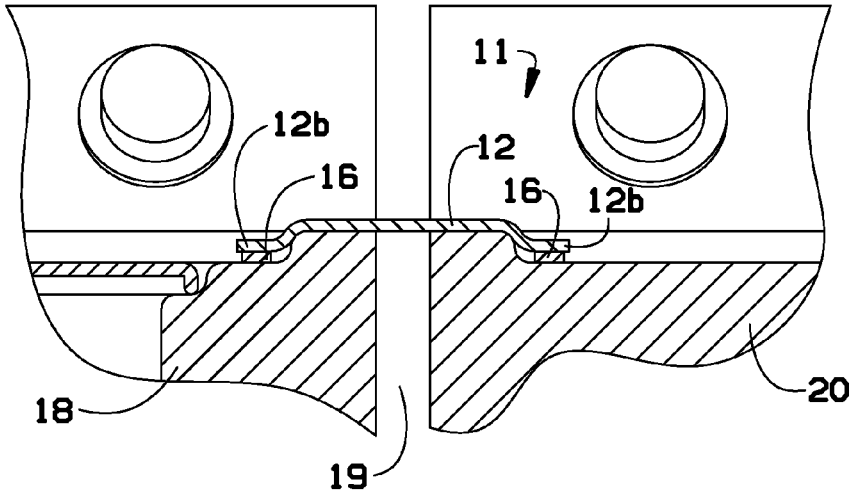
FIG. 5 shows a detail section view of the gap bridging device in accordance with an alternate embodiment of the present invention.
Figure 6:
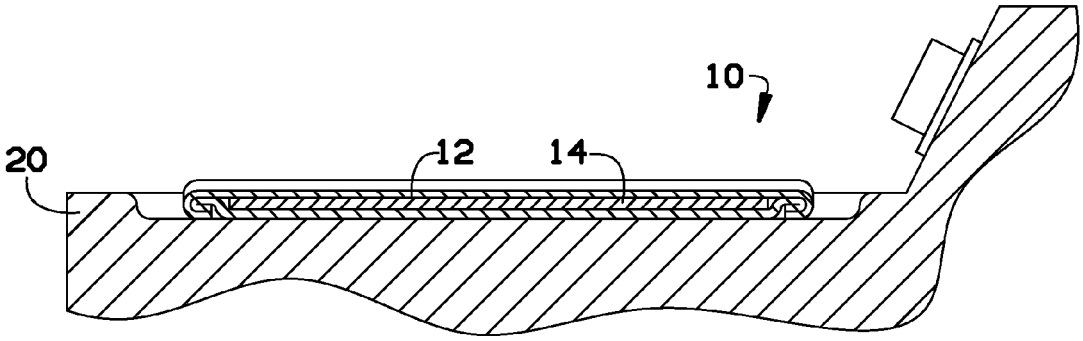
FIG. 6 shows a section view of the gap bridging device of FIG. 1 taken along line 6-6 of FIG. 3.
Figure 7:
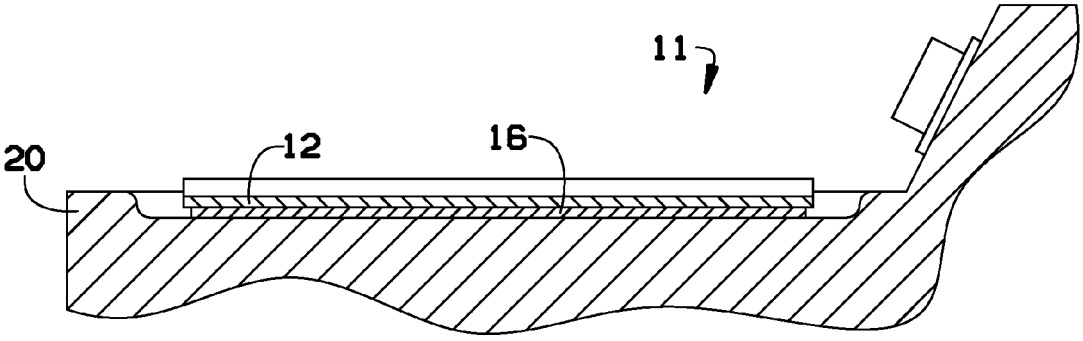
FIG. 7 shows a detail section view of the gap bridging device of FIG. 5.

Referring now to FIGS. 5 and 7, in accordance with an alternate exemplary embodiment of the present invention, the device 10 may comprise the piece of material 12 and fastening systems 16. The fastening systems 16 may comprise adhesive strips, hook and loop fasteners, or any other systems for attaching the device 10. The fastening systems 16 may replace the magnets 14 and may be similarly used as the magnets 14 in order to attach the piece of material 12 to the washer 18 and the dryer 20 in order to bridge at least a portion of the gap 19. In that case, the fastening systems 16 may be attached to the piece of material 12 on the two long sides 12*b* of the piece of material 12 instead of being sewn or sealed, such as shown in FIG. 4, into the channels 12*a* of the piece of material 12.

If non-magnetic fastening systems 16 are employed on the device 10, the device 10 may also be used to cover wall gaps 21 from the washer 18 or dryer 20 to a wall 22. One long end 12*b* of the piece of material 12 may be attached to the washer 18 or dryer 20 via a fastening system 16 and another long end 12*b* of the piece of material 12 may be attached to the wall 22 via another fastening system 16. Alternatively one long end 12*b* of the piece of material 12 may be attached via a fastening system 16 to the side 18*b* of the washer 18 while another long side 12*b* of the piece of material 12 may be attached via another fastening system 16 to the side 20*b* of the dryer 20. The device 10 employing fastening systems 16 may also be used to cover the gaps 19 between washers 18 and dryers 20 if the washers 18 and dryers 20 do not have any metal surfaces for the magnets 14 to attach.

In an alternative embodiment, instead of situating the device 10 across the top 18*a* and 20*a* of the washer 18 and dryer 20, respectively, the device 10 may also be attached to the sides 18*b* and 20*b* of the washer 18 and dryer 20, respectively, between the washer 18 and dryer 20. In this case, the piece of material 12 may form more of a hammock shape rather than being taut, but the piece of material 12 may still be operable to catch and hold falling items so that the items may still be easily retrieved from the device 10.

Although the device 10 has been discussed in terms of its use with side-by-side washers 18 and dryers 20, the device 20 may also be used with top-loading washers 18 and dryers 20.

It should be understood, of course, that the foregoing relates to exemplary embodiments of the invention and that modifications may be made without departing from the spirit and scope of the invention as set forth in the following claims.

I claim:

1. A device for bridging a gap, consisting of:

(a) one layer of breathable fabric, rectangular shaped, of a color that avoids transfer of color from wet items, to cover at least a portion of a gap between a washer and dryer; and (b) magnets attached to and extending along most of two long sides of the device.

2. The device according to claim 1, wherein the device is fourteen inches to eighteen inches long and six inches to eight inches wide.

3. The device according to claim 1, wherein the fabric is breathable, and white in color.

4. The device according to claim 1, wherein channels are sealed along the two long ends of the device to house the magnets which are either magnetic strips or a plurality of magnets.

5. The device according to claim 1, wherein channels to house the magnets are sewn or sealed.

* * * * *